United States Patent [19]

Rioux

[11] Patent Number: 4,680,008

[45] Date of Patent: Jul. 14, 1987

[54] HIGH TEMPERATURE FURNACE FOR INTEGRATED CIRCUIT MANUFACTURE

[75] Inventor: Brian A. Rioux, Kanata, Canada

[73] Assignee: Northern Telecom Limited, Montreal, Canada

[21] Appl. No.: 938,903

[22] Filed: Dec. 8, 1986

[51] Int. Cl.[4] ..... F23J 15/00

[52] U.S. Cl. ..... 432/72; 110/210; 110/211; 432/222

[58] Field of Search ..... 432/121, 72, 222; 110/210, 211

[56] References Cited

U.S. PATENT DOCUMENTS

| | | | |
|---|---|---|---|
| 2,538,412 | 1/1951 | Cecil et al. | 432/72 |
| 3,306,335 | 2/1967 | Myers | 432/222 |
| 3,706,446 | 12/1972 | Briggs | 432/222 |
| 3,822,987 | 7/1974 | Zanft | 432/222 |
| 3,917,442 | 11/1975 | Zagoroff | 432/222 |
| 4,060,379 | 11/1977 | Lattaye et al. | 432/179 |
| 4,082,497 | 4/1978 | Crawford et al. | 432/222 |
| 4,457,704 | 7/1984 | Sommers et al. | 432/222 |
| 4,508,669 | 4/1985 | Iwai et al. | 432/72 |

*Primary Examiner*—Henry C. Yuen

*Attorney, Agent, or Firm*—John E. Mowle

[57] ABSTRACT

A high temperature furnace including a furnace chamber maintained at an internal temperature above the ignition temperature of a gas mixture used for the growth of oxide layers on silicon substrates therein. A separate burn chamber is used to mix and burn the gas mixture. A tube conveys the mixture into the furnace chamber so that ignition of the gas mixture in the furnace chamber creates a flame front that travels back along the tube to the burn chamber to sustain ignition therein.

4 Claims, 3 Drawing Figures

HIGH TEMPERATURE FURNACE FOR INTEGRATED CIRCUIT MANUFACTURE

This invention relates to a high temperature furnace and more particularly to an improved pyrogenic hydrogen burner which may be utilized to grow oxide layers on silicon substrates in such a furnace

BACKGROUND OF THE INVENTION

In the manufacture of integrated circuits a number of high temperature processes are employed to grow oxide layers on the silicon substrates. These take place in quartz lined high temperature furnaces. Oxidations which must be grown quickly are usually preformed in a steam ambient which is created by burning hydrogen in oxygen within the furnace itself. This can lead to temperature control instabilities since burning hydrogen generates appreciable amounts of heat. Pyrogenic heating is especially bad in large diameter furnaces which must be purged with high gas flows to prevent atmospheric backsteaming.

One solution to this dilemma has been to locate the hydrogen burner outside of the furnace tube which eliminates the unwanted heat from the furnace. A number of these furnaces already exist in the industry but their complexity and cost have led to limited acceptance. The major reason is that such burners utilize a separate burn chamber which has its own ignition system with temperature and safety controls.

STATEMENT OF THE INVENTION

The present invention overcomes the drawbacks of prior furnaces by utilizing a separate furnace chamber and burn chamber as described above. However the burn chamber is connected to the furnace chamber in such a way that the heat in the furnace chamber can be utilized to provide ignition for the gas mixture in the burn chamber thereby eliminating the duplicate heating elements and controls. This provides both a considerable cost saving as well as a reduction in the complexity of the overall furnace.

Thus, in accordance with the present invention there is provided a high temperature furnace for the growth of oxide layers on silicate substrates and the like, in which the furnace comprises a furnace chamber and a heating means for maintaining the internal temperature of the chamber at a temperature greater than the ignition temperature of a hydrogen-oxygen gas mixture. The high temperature furnace also includes a burn chamber external to the furnace chamber for mixing and burning the gas mixture. It also includes a tube for conveying the gas mixture from the burn chamber to the furnace chamber. To ensure proper combustion of the gas mixture, the tube protrudes into the furnace chamber a sufficient distance that the ambient temperature at the point where the gas mixture is expelled from the tube, is greater than the ignition temperature. As a result, the gas mixture upon ignition in the furnace chamber creates a flame front that travels back along the tube into the burn chamber to sustain ignition therein.

BRIEF DESCRIPTION OF THE FORMAL DRAWINGS

Examples of prior art high temperature furnaces and an example embodiment of the high temperature furnace of the present invention will now be described with reference to the accompanying drawings in which.

DESCRIPTION OF THE PREFERRED EMBODIMENT AND THE PRIOR ART

Figure 1:
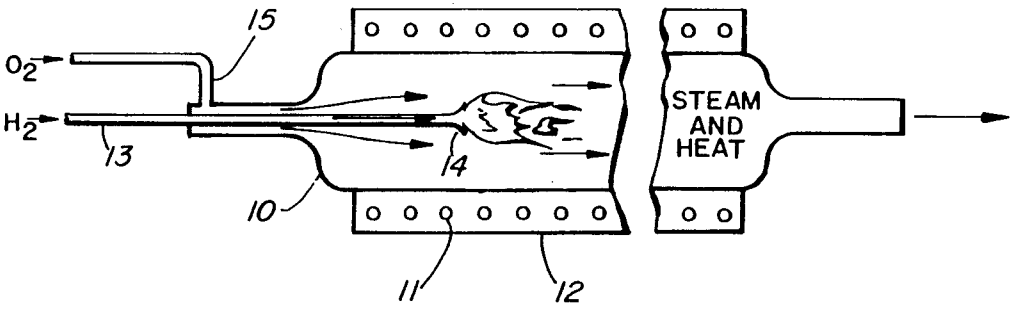
FIG. 1 PRIOR ART
FIG. 1 is an example of a prior art high temperature furnace having a standard hydrogen burner-injector tube located in the furnace chamber.

Referring to FIG. 1, there is illustrated a prior art high temperature furnace which utilizes an internal hydrogen burner. The furnace comprises a conventional quartz lined furnace chamber or tube 10 surrounded by an electric heating element 11 encased in a stainless steel protective cover 12. The heating element 11 maintains the temperature of the furnace chamber 10 at a minimum of about 650° C. which is above the ignition temperature of a hydrogen-oxygen gas mixture. Conventional heating and safety controls (not shown) are utilized to control the heating element 11.

To provide the steam which is used to grow oxide on a silicon substrate, hydrogen ($H_2$) is introduced via a quartz tube 13 which has a flared end 14 for evenly dispersing the hydrogen gas into the furnace chamber 10. Concurrently, oxygen ($O_2$) is introduced in a concentric quartz tube 15 surrounding the tube 13, and ignites the hydrogen in the heated chamber 10 to produce steam from the reaction $2H_2+O_2=2\ H_2O$. This pyrogenic reaction generates a good deal of heat in the furnace chamber 10 which is difficult to control, and as stated earlier, is of particular concern in new, larger diameter furnaces which must be purged with high gas flows to prevent atmospheric backsteaming.

Figure 2:
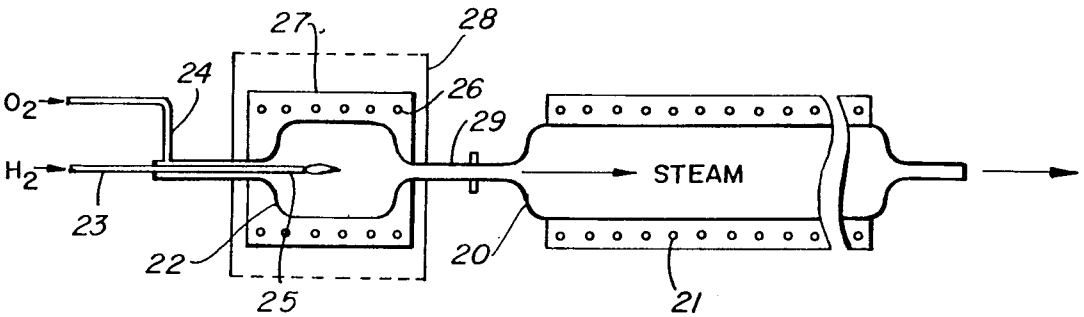
FIG. 2 PRIOR ART
FIG. 2 is an example of a prior art high temperature furnace having an external burn chamber with its own ignition source.

This heat problem has been alleviated by the development of a high temperature furnace in which the reaction takes place outside the furnace chamber in a separate compartment as illustrated in the prior art furnace of FIG. 2. Here a quartz lined furnace chamber 20 with its controlled heating element 21 is coupled to a quartz lined burn chamber 22 in which the hydrogen and oxygen gases are introduced by tubes 23 and 24 respectively, in a similar manner to that illustrated in the prior art furnace of FIG. 1. However because the burn chamber 22 is much smaller and there is no need to have even dispersion of the heat a much simpler injector nozzle 25 can be utilized on the end of the tube 23.

To provide ignition for the hydrogen-oxygen gas mixture, the burn chamber 22 also includes a temperature controlled heating element 26 encased in a stainless steel housing 27 and safety cage 28. Steam from the pyrogenic reaction is coupled through an interconnecting tube 29 to the furnace chamber 20. However much of the heat escapes from around the burn chamber 22 through the safety cage 28 so as to minimize pyrogenic heating in the furnace chamber 20. Thus, while this prior art structure provides good temperature control in the furnace chamber 20, it is considerably more costly particularly because a separate controlled heating element 26 is required for the burn chamber 22.

One problem with this structure is that if the heating element 26 was to fail and the unignited hydrogen-oxygen gas mixture was allowed to enter the furnace chamber 20, it would initially be widely dispersed so that it would not immediately ignite even though the temperature in the furnace chamber 20 is above the ignition point of the gas mixture. After a considerable amount of the gas mixture has accumulated in the furnace chamber 20 it would ignite with a fairly violent reaction causing damage to the quartz ware in one or both of the chambers 20 and 22. Thus with this prior art structure, additional safety controls have to be installed to ensure that the gas supply is not turned on before the minimum ignition temperature of the burn chamber 22 is reached.

Figure 3:
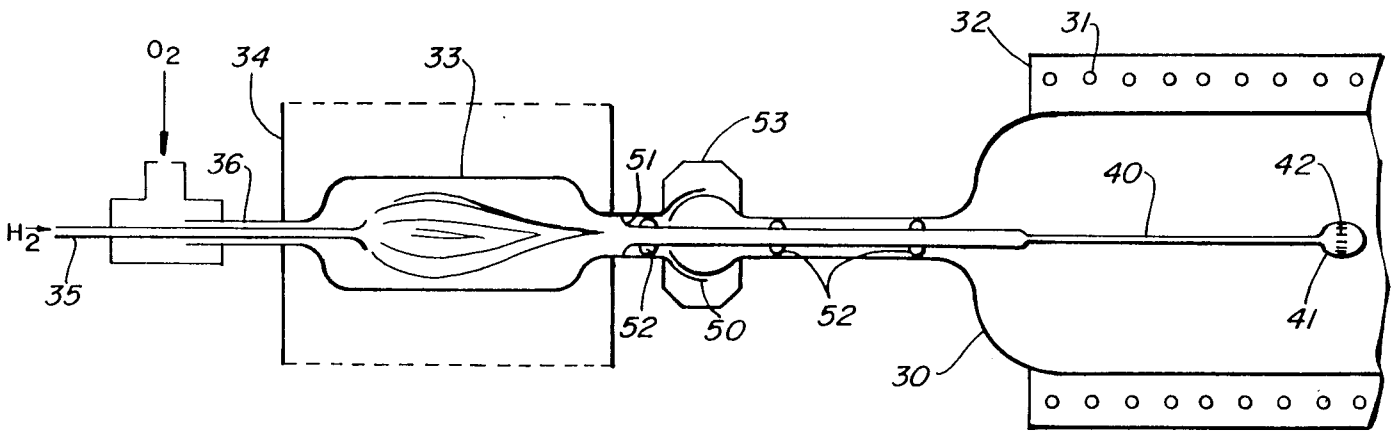
FIG. 3 is a high temperature furnace in accordance with the present invention having an external burn chamber which eliminates the need for a separate ignition source and control.

Referring to FIG. 3, the high temperature furnace of the present invention comprises a quartz lined furnace chamber 30 surrounded by a controlled heating element 31 encased in a stainless steel housing 32 as in both the prior art furnaces. In addition, it includes a quartz lined burn chamber 33 encased in a stainless steel safety cage 34, which is fed by hydrogen and oxygen gas through quartz tubes 35 and 36 respectively. The burn chamber 33 is similar to that shown in the prior art chamber 22 in FIG. 2 but differs in that it does not contain any heating element or temperature and safety controls. In addition, the output of the hydrogen-oxygen gas mixture from the burn chamber 33 is conveyed to the furnace chamber 30 via an ignition injector tube 40, which protrudes about 25 cm inside the furnace chamber 30. A bulbous end 41 of the protruding tube 40 has a plurality of peripheral slots 42 which evenly distribute the gas mixture in a confined or concentrated area. Because these slots 42 are well spaced from the walls of the furnace chamber 30, the ambient temperature of the bulbous end 41 of the tube 40 is well above the minimum ignition temperature for the hydrogen-oxygen gas mixture. As a result of this gas concentration and the temperature of the chamber 30, the initial ignition of the mixture takes place very rapidly once the gas mixture starts to flow along the tube 40 where the temperature has reached the ignition point of about 650 degrees C. This creates a flame front that travels back along the tube 40 into the burn chamber 33 to ignite and sustain ignition therein without the need for heating elements or other ignition sources within this chamber 33. Even though the volume of the burn chamber 33 is much smaller than that of the furnace chamber 30, a small explosion will still take place. The cross-sectional area of the tube 40 and hence its diameter is selected so as to dampen any pressure front resulting from ignition of the gas mixture in the burn chamber 33 thereby minimizing any possible damage to the furnace. A typical internal diameter for the tube is 6 mm. Typical gas flows for such a chamber are up to 4.5 l/min. for $H_2$ and 3.0 l/min. for $O_2$ with a 3:2 ratio being maintained. Lower flows are acceptable as long as the mix ratio is correct. Higher flows will result in overheating of the burn chamber 33.

The interconnection of the burn chamber 33 and the furnace chamber 30 is a ball-and-socket joint 50. The injector tube 40 is flared at its other end 51 and clamped between the ball-and-socket joint 50 by a stainless steel clamp 53. Small protrusions 52 on the sides of the tube 40 ensure a tight fit between the tube 40 and the end of the furnace chamber 30. The slots 42 are disposed so as to direct the steam back towards the end where the tube 40 protrudes into the chamber 30 so as to ensure that the whole chamber 30 is purged.

What is claimed is:

1. A high temperature furnace for the growth of oxide layers on silicon substrates and the like, the furnace comprising:

a furnace chamber;

heating means for maintaining the internal temperature of the chamber at a temperature greater than the ignition temperature of a gas mixture; and a burn chamber external to the furnace chamber for mixing and burning said gas mixture therein;

characterized by:

a tube for conveying the gas mixture from the burn chamber to the furnace chamber;

one end of the tube protruding into the furnace chamber a sufficient distance that the ambient temperature, contiguous an opening in the tube which expels the gas mixture into the furnace chamber, is greater than said ignition temperature, resulting in ignition of the gas mixture in the furnace chamber which creates a flame front that travels back along the tube into the burn chamber, to initiate and sustain ignition the burn chamber and the furnace chamber are joined at a mating ball-and-socket joint; and the other end of the tube is flared and clamped between the mating ball-and-socket joint.

2. A high temperature furnace as defined in claim 1 in which said one end of the tube has a plurality of peripheral openings orthogonal to the length of the tube, so that the gas mixture purges the furnace chamber where the tube protrudes therein.

3. A high temperature furnace as defined in claim 2 in which:

the gas mixture, containing hydrogen and oxygen, produces steam when ignited, and the heating means maintains the furnace chamber at a temperature greater than about 650 degrees centigrade.

4. A high temperature furnace as defined in claim 3 in which:

the cross-sectional area of the tube is selected so as to dampen any pressure front resulting from ignition of the gas mixture in the burn chamber.

* * * * *